US011415030B2

(12) United States Patent
Ströse et al.

(10) Patent No.: US 11,415,030 B2
(45) Date of Patent: Aug. 16, 2022

(54) SUCTION DEVICE FOR CRANKCASE VENTILATION

(71) Applicants: Joma-Polytec GmbH, Bodelshausen (DE); Bayerische Motoren Werke Aktiengesellschaft, Munich (DE)

(72) Inventors: Jörg Ströse, Eglharting (DE); Christian Scheibe, Rottenburg am Neckar (DE); Tobias Köhnlein, Hechingen (DE)

(73) Assignees: Joma-Polytec GmbH, Bodelshausen (DE); Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 16/761,333

(22) PCT Filed: Jan. 7, 2019

(86) PCT No.: PCT/EP2019/050207
§ 371 (c)(1),
(2) Date: May 4, 2020

(87) PCT Pub. No.: WO2019/179665
PCT Pub. Date: Sep. 26, 2019

(65) Prior Publication Data

US 2021/0189925 A1 Jun. 24, 2021

(30) Foreign Application Priority Data

Mar. 22, 2018 (DE) ..... 10 2018 106 881.6

(51) Int. Cl.
*F01M 13/04* (2006.01)
*F01M 13/02* (2006.01)
(Continued)

(52) U.S. Cl.
CPC ..... *F01M 13/04* (2013.01); *F01M 13/022* (2013.01); *F01M 2013/0005* (2013.01);
(Continued)

(58) Field of Classification Search
CPC ..... F01M 13/04; F01M 13/022; F01M 2013/0005; F01M 2013/026;
(Continued)

(56) References Cited

U.S. PATENT DOCUMENTS

2002/0041813 A1* 4/2002 Fledersbacher ..... F01D 15/10 417/407
2011/0038717 A1* 2/2011 Lee ..... F02C 6/12 415/170.1

(Continued)

FOREIGN PATENT DOCUMENTS

DE 20302824 7/2004
DE 102009036476 5/2010

(Continued)

OTHER PUBLICATIONS

International Search Report for International Application No. PCT/EP2019/050207, dated Apr. 8, 2019.

(Continued)

*Primary Examiner* — Syed O Hasan
(74) *Attorney, Agent, or Firm* — Bond Schoeneck & King, PLLC; George McGuire

(57) ABSTRACT

The invention enables an adequate crankcase negative pressure in an internal combustion engine, in all operating ranges to the extent possible and using a suction device for the crankcase ventilation of an internal combustion engine, which suction device is equipped with a housing, a controllable electric motor and a compressor for conveying crankcase gas, which compressor is driven by the electric motor, the compressor having connection points for a crankcase
(Continued)

ventilation line, such that the crankcase pressure of the internal combustion engine is controllable by controlling the electric motor.

6 Claims, 6 Drawing Sheets

(51) Int. Cl.
*F01M 13/00* (2006.01)
*F04D 25/04* (2006.01)
*F04D 29/28* (2006.01)

(52) U.S. Cl.
CPC . *F01M 2013/026* (2013.01); *F01M 2013/027* (2013.01); *F04D 25/045* (2013.01); *F04D 29/284* (2013.01)

(58) Field of Classification Search
CPC ..... F01M 2013/027; F01M 13/021; F01M 11/004; F01M 2013/0427; F04D 25/045; F04D 29/284
See application file for complete search history.

(56) References Cited

U.S. PATENT DOCUMENTS

2018/0017069 A1* 1/2018 Boutros-Mikhail ..... F04D 29/441
2018/0030868 A1* 2/2018 Elsaesser ..... F04D 29/706

FOREIGN PATENT DOCUMENTS

| | | | |
|---|---|---|---|
| DE | 102013215611 | * | 3/2015 |
| DE | 102015202946 | | 8/2016 |
| DE | 102015220132 | | 4/2017 |
| DE | 112016000526 | | 12/2017 |
| DE | 10217212861 | | 2/2018 |
| EP | 1532353 B1 | | 11/2009 |
| EP | 2166202 A1 | | 3/2010 |
| EP | 2616645 B1 | | 2/2017 |

OTHER PUBLICATIONS

Office Action dated for German Application No. 10 2018 106 881.6 dated Feb. 15, 2019.

* cited by examiner

SUCTION DEVICE FOR CRANKCASE VENTILATION

CROSS REFERENCE TO RELATED APPLICATIONS

This is a National stage application, filed under 37 U.S.C. 371, of the International application No. PCT/EP2019/050207, filed on Jan. 7, 2019, which claims priority to German Patent Application No. DE 10 2018 106 881.6, filed Mar. 22, 2018, the entire contents of which is incorporated herein by reference.

BACKGROUND

The invention relates to a suction device for the crankcase ventilation of an internal combustion engine. The invention further relates to a crankcase ventilation for discharging crankcase gas from an internal combustion engine. The invention also relates to an internal combustion engine.

The classic crankcase ventilation, in which negative pressure is used to extract crankcase gas from the intake tract of the internal combustion engine, is known from the prior art for the discharge of crankcase gas from the crankcase of an internal combustion engine. A crankcase ventilation line provides a flow connection between the crankcase and components of the intake tract, whereby, as a result of the negative pressure prevailing in the intake tract, crankcase gas can be conveyed from the crankcase to the intake tract. However, it is problematic here that the conveying effect depends on the negative pressure prevailing in the intake tract, which primarily depends on the engine speed, so that a sufficient crankcase negative pressure cannot be provided in all operating states. This leads to losses and therefore a drop in engine performance.

The object of the invention is to enable an adequate crankcase negative pressure in an internal combustion engine in all operating ranges to the extent possible and using simple design means.

SUMMARY OF THE INVENTION

The invention achieves this using a suction device having the features of claim 1. According to the invention, the suction device is configured with a housing, a controllable electric motor and a compressor driven by the electric motor for conveying crankcase gas, the compressor having connection points for a crankcase ventilation line, so that the crankcase pressure of the internal combustion engine is controllable or may be controlled by controlling the electric motor.

Such an embodiment has the advantage that an adequate crankcase negative pressure can be provided by the suction device in all operating states of the internal combustion engine. With the controllable electric motor, the crankcase negative pressure may be adjusted independently of the operating state of the internal combustion engine, for example its engine speed, and not only reduced, but also controlled. In this way, performance losses arising as a result of inadequate crankcase negative pressure can be reduced.

As already explained, the suction device is used for crankcase ventilation, in particular therefore, for discharging crankcase gas from the crankcase of an internal combustion engine. The connection points (inlet and outlet) provided on the compressor are used for connection to a crankcase ventilation line (establishing a flow connection with the crankcase ventilation line). The suction device may thus be connected to a crankcase ventilation line via the compressor and thus incorporated or integrated into a crankcase ventilation.

The crankcase negative pressure may be controlled in particular by controlling the engine speed. The electric motor is arranged in particular in the housing of the suction device. The suction device is configured in particular as a compact unit that may be attached to an internal combustion engine as an auxiliary unit.

In a preferred embodiment, the compressor and the electric motor may at least partially overlap one another axially (along an axial direction), the compressor surrounding the electric motor radially outwardly at least in sections. In this way, the electric motor may be cooled by the crankcase gas passing through the compressor (compressor channel). In other words, crankcase gas can flow around the electric motor and thus be cooled. The resulting cooling effect makes it possible for inexpensive components to be used for the electric motor (high temperature resistance not required). To achieve a high cooling effect, it is advantageous if the electric motor and the compressor adjoin one another over large-area contact sections. The axial direction is in particular oriented parallel to the axis of rotation of the electric motor or compressor.

The electric motor may advantageously have an externally running rotor (external rotor motor), which is coupled, in particular in a rotationally fixed manner, to the impeller of the compressor. This creates a structurally simple and stable connection between the electric motor (rotor) and the compressor impeller. In addition, due to the comparatively large contact areas, high heat dissipation can take place via the impeller. The electric motor may have a preferably cylindrical cap, which is coupled in a rotationally fixed manner to the rotor and is connected to a motor shaft. The cap may have a wall which is arranged radially between the rotor and the contact section of the compressor impeller.

The compressor may expediently be configured as a side channel compressor. This enables comparatively high differential pressures to be achieved with a compact design. The side channel compressor may have a compressor channel, an inlet opening into it (first connection point), an outlet also opening into it (second connection point) and an impeller arranged in the compressor channel and driven by the electric motor. The side channel is the section of the compressor channel that remains clear in the assembled state (is not taken up by the impeller).

The housing of the suction device has in particular a plurality of separate housing sections. In the context of a preferred embodiment, the housing may have one or more outwardly protruding cooling fins, for example one to ten cooling fins, on a housing section facing away from the compressor. This further promotes heat dissipation from the interior of the housing of the suction device. The heat generated in the housing may also be dissipated to the outside via the cooling fins.

An electronic control for the electric motor may expediently be provided which adjoins the housing section equipped with cooling ribs, in particular having at least partial surface contact with the wall of the housing section. For example, the electronic control or its components, for example an assembled printed circuit board, may at least partially rest against the inside of the wall of this housing section. In this way, a cooling of the control for the electric motor is also possible. This means that comparatively inexpensive components may also be used for the control (high temperature resistance not required).

The housing may advantageously have a holder for fastening on a housing section facing away from the compressor and/or on a housing section which delimits the compressor to the outside (holding section for fastening). This enables the suction device to be easily installed on other components or fastening points of the internal combustion engine. The one or more holders are in particular configured such that heat can be dissipated from the interior of the housing. In this way, heat can be dissipated from the interior of the housing to adjacent components, for example to a housing or to components of the internal combustion engine. This contributes to high heat dissipation from the interior of the suction device. The holder or holders may be metallic and/or have comparatively large cross sections.

As already explained above, the housing of the suction device may have a plurality of housing sections. Adjacent housing sections may adjoin one another, for example rest against one another, at parting planes. The parting planes are in particular oriented orthogonally relative to the axis of rotation of the electric motor or the compressor. This favors the manufacture and assembly of the suction device.

Specifically, a first housing section can outwardly delimit the compressor, in particular axially in half. In this first housing section, a section of the compressor channel, in particular the side channel, may be formed into which the connection points, which are likewise preferably formed on the first housing section, open. A holder for fastening the suction device may be formed on the first housing section, in particular on the side facing away from the side channel.

The second half of the compressor channel, in which the compressor impeller can be arranged, may be formed in a second housing section which adjoins the first housing section. In addition, the electric motor, at least in most cases, may be arranged in the second housing section and/or attached to the second housing section.

A third housing section, which adjoins the second housing section, may form a partition between the components in the second housing section and further housing sections, which, for example, house a controller. Due to the separation realized with the third housing section, the housing may be subdivided into a compressor housing part (first and second housing section) and an electronics housing part (fourth housing section).

A fourth housing section, which adjoins the third housing section, may delimit the housing of the suction device on the side facing away from the compressor. An outwardly protruding holder for fastening the suction device may be formed on the fourth housing section. In addition, cooling fins may be formed on the fourth housing section for improved heat dissipation from the interior of the housing of the suction device, as already explained above.

For improved heat dissipation, one or more, preferably all, housing sections of the suction device, in particular also holders and/or cooling fins, may be metallic.

The aforementioned object is also achieved by a crankcase ventilation for discharging crankcase gas from an internal combustion engine having the features of the independent claim. Regarding the advantages that are achievable with this, reference is made to the explanations related to the suction device.

The crankcase ventilation has at least one crankcase ventilation line, which is configured to connect the crankcase of an internal combustion engine to its intake tract (e.g. air intake line) (establishing a flow connection between the crankcase and intake tract). The suction device is connected to the crankcase ventilation line via the connection points on the compressor, so that crankcase gas can be conveyed to the intake tract by means of the suction device. By controlling the electric motor that drives the compressor, the crankcase pressure in the internal combustion engine may be controlled.

One or more oil mist separators, for example a partial load separator and a full load separator, may be connected upstream of the suction device in the crankcase ventilation line. Oil separated there can be returned to the internal combustion engine, for example to its oil sump, via an oil return line.

The aforementioned object is also achieved by an internal combustion engine having the features of the independent claim. Regarding the advantages that are achievable with this, reference is made to the explanations related to the suction device.

The internal combustion engine may have a crankcase ventilation for discharging crankcase gas as described above. The crankcase ventilation may have a suction device for crankcase ventilation as described above.

The internal combustion engine may have further components. First of all, the internal combustion engine may have an intake tract (air intake or feed line) and an exhaust tract (exhaust gas line or discharge line). The intake tract may extend from an air intake point to the combustion chamber. The exhaust tract may extend from the combustion chamber to an exhaust gas discharge point (e.g. exhaust muffler).

One or more of the following components may be provided in the intake tract: air filter, air mass meter (e.g. hot film air mass meter), compressor unit (e.g. compressor side of a turbocharger), charge air cooler, throttle valve. A turbine unit (turbine side of a turbocharger) may be provided in the exhaust tract. The turbine wheel of the turbine unit may in particular be coupled to the compressor wheel of the compressor unit by means of a shaft.

BRIEF DESCRIPTION OF THE DRAWINGS

The description will be explained in more detail below with reference to the drawings, identical or functionally equivalent elements being provided only once with reference signs if necessary. In the drawings.

DETAILED DESCRIPTION

Figure 1:
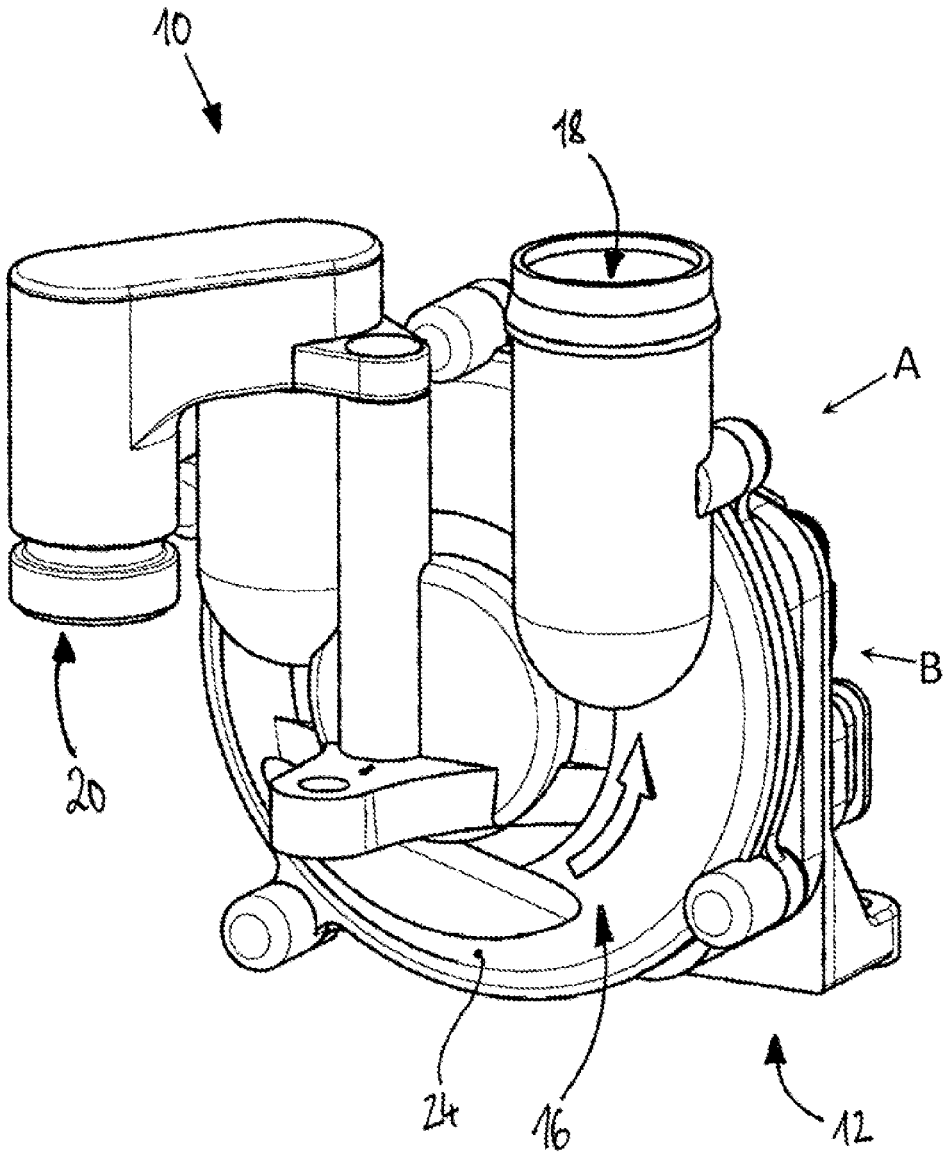
FIG. 1 is an exemplary embodiment of a suction device in a perspective view.

FIG. 1 shows a suction device for crankcase ventilation of an internal combustion engine and is designated overall by reference sign 10. The suction device 10 has a housing 12, a controllable electric motor 14 (see FIG. 4) and a compressor 16 driven by the electric motor 14 for conveying crankcase gas (see FIG. 1). The electric motor 14 is arranged in the housing 12.

Figure 6:
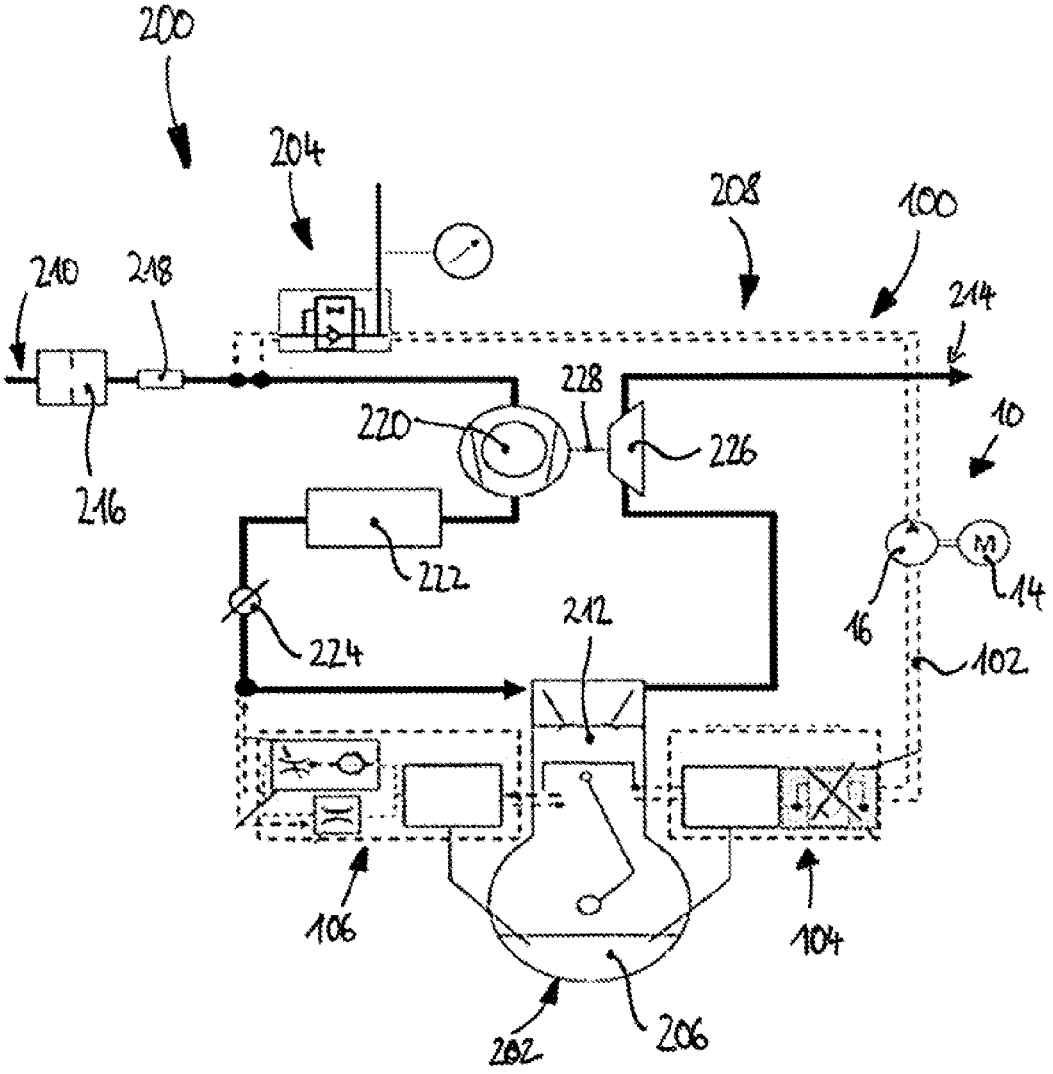
FIG. 6 is an exemplary embodiment of a crankcase ventilation and an internal combustion engine having a suction device in a schematic diagram.

The compressor 16 has connection points 18, 20 for connection to a crankcase ventilation line 102 (see FIG. 6).

Thus, by controlling the electric motor 14, in particular by controlling its engine speed, the crankcase pressure of the internal combustion engine may be controlled.

The connection point 18 is an output from the compressor 16 (see FIG. 1). The connection point 20 serves as an input into the compressor 16. A section of a crankcase ventilation line may be connected at the connection point 20, which connects the crankcase of the internal combustion engine to the connection point 20 of the compressor 16 (flow connection). A section of a crankcase ventilation line may be connected at the connection point 18, which connects the connection point 18 to the intake tract of the internal combustion engine (flow connection). The connection points 18, 20 open into the compressor channel 22 of the compressor 16 (see FIG. 4).

The housing 12 has a plurality of separate housing sections, each one adjoining the other at parting planes and collectively forming the housing 12. In the present case, the housing 12 has four housing sections 24, 26, 28, 30 which adjoin one another at three mutually parallel separation planes 32, 34, 36. The housing sections 24, 26, 28, 30 are fastened to one another, for example glued and/or screwed.

Figure 2:
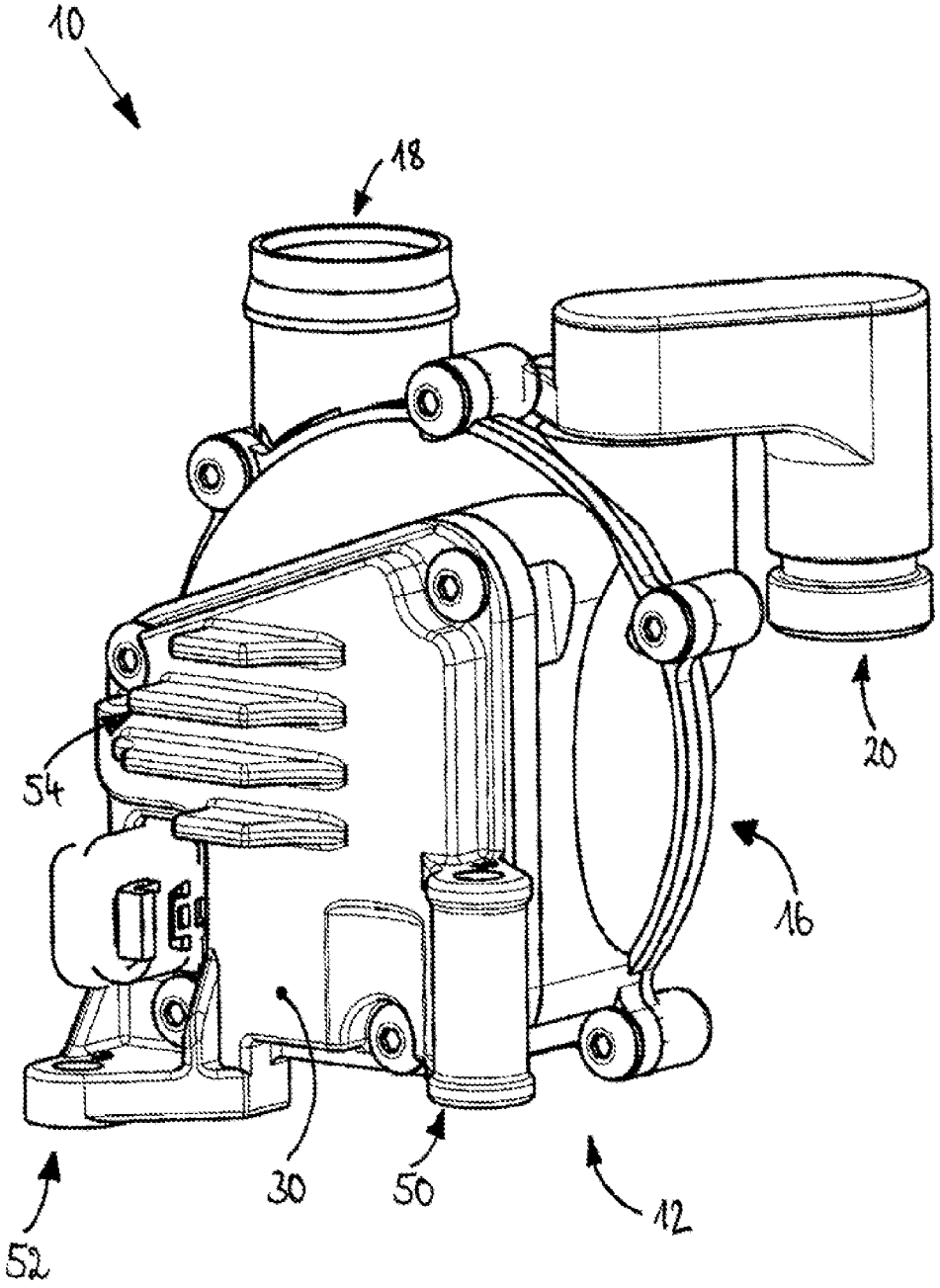
FIG. 2 is the suction device from FIG. 1 in a further perspective view according to arrow A in FIG. 1.
Figure 3:
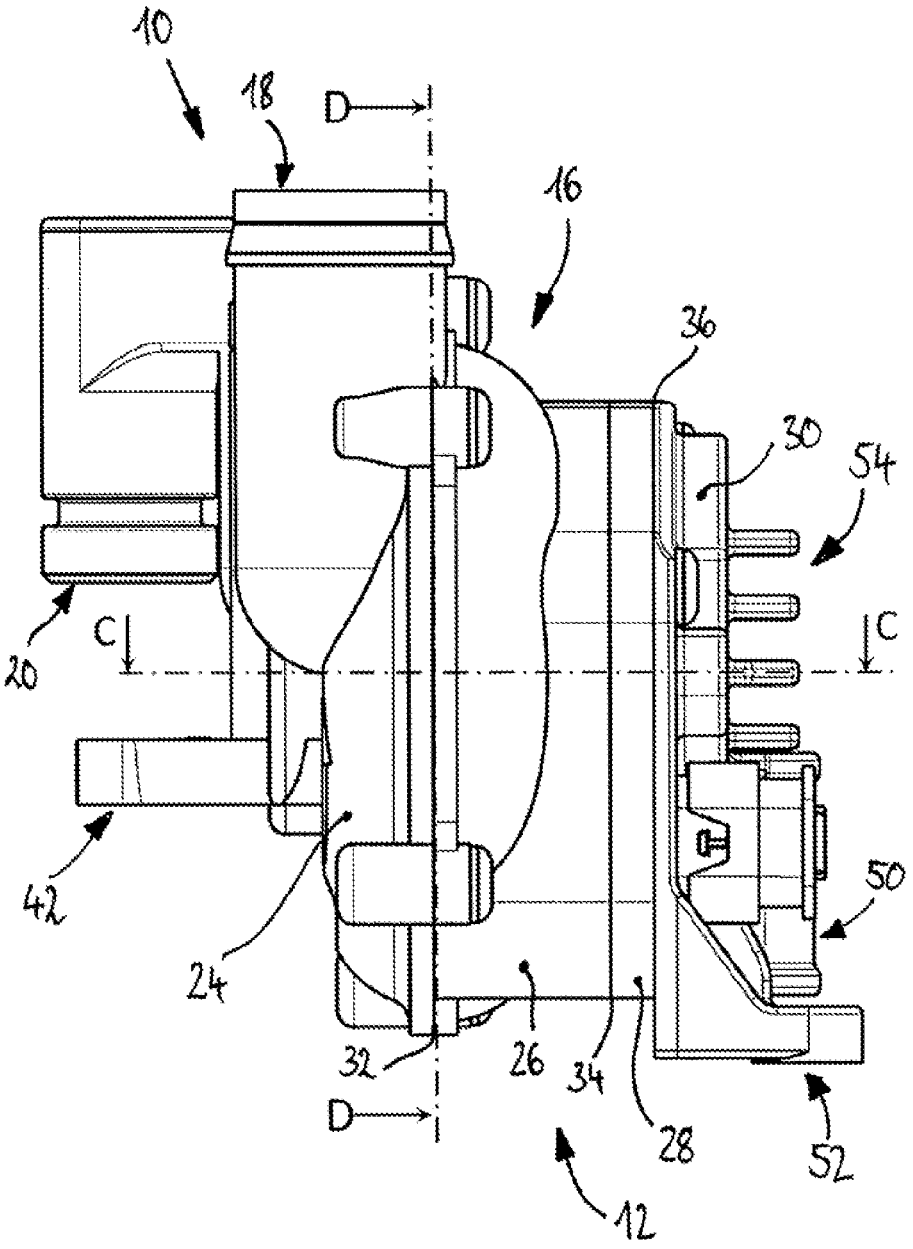
FIG. 3 is the suction device from FIG. 1 in a side view according to arrow B in FIG. 1.

The first housing section 24 outwardly delimits the compressor channel 22 to one side of the housing 12. Part of the compressor channel 22 (side channel 38) is formed in the first housing section 24. The compressor 16 is configured as a side channel compressor. In addition, the first housing section 24 delimits a receiving space 40 for the electric motor 14. The connection points 18, 20 are formed on the first housing section 24 and open into the compressor channel 22 (see FIGS. 1 and 2). A holder 42 for fastening the suction device 10 is also formed on the first housing section 24 and protrudes outwardly from the first housing section 24.

Figure 4:
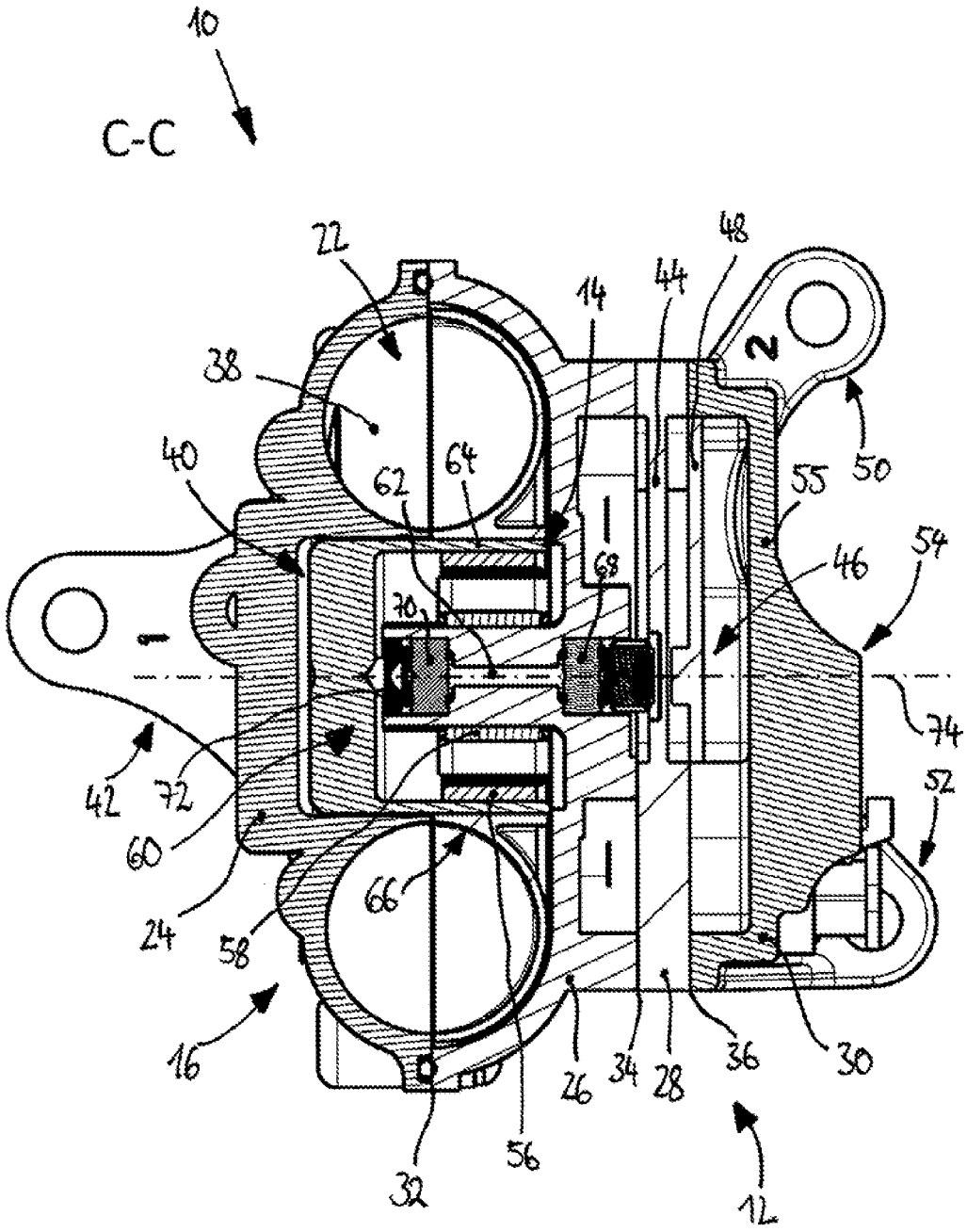
FIG. 4 is the suction device from FIG. 1 in a sectional view along the section axis C-C in FIG. 3.

The second housing section 26 delimits the compressor channel 22 on the inside relative to the housing 12 (see FIG. 4). The impeller 41 of the compressor 16 is arranged in the part of the compressor channel 22 formed in the second housing section 26. In addition, the electric motor 14 arranged in the receiving space 40 is fastened to the second housing section 26.

Figure 5:
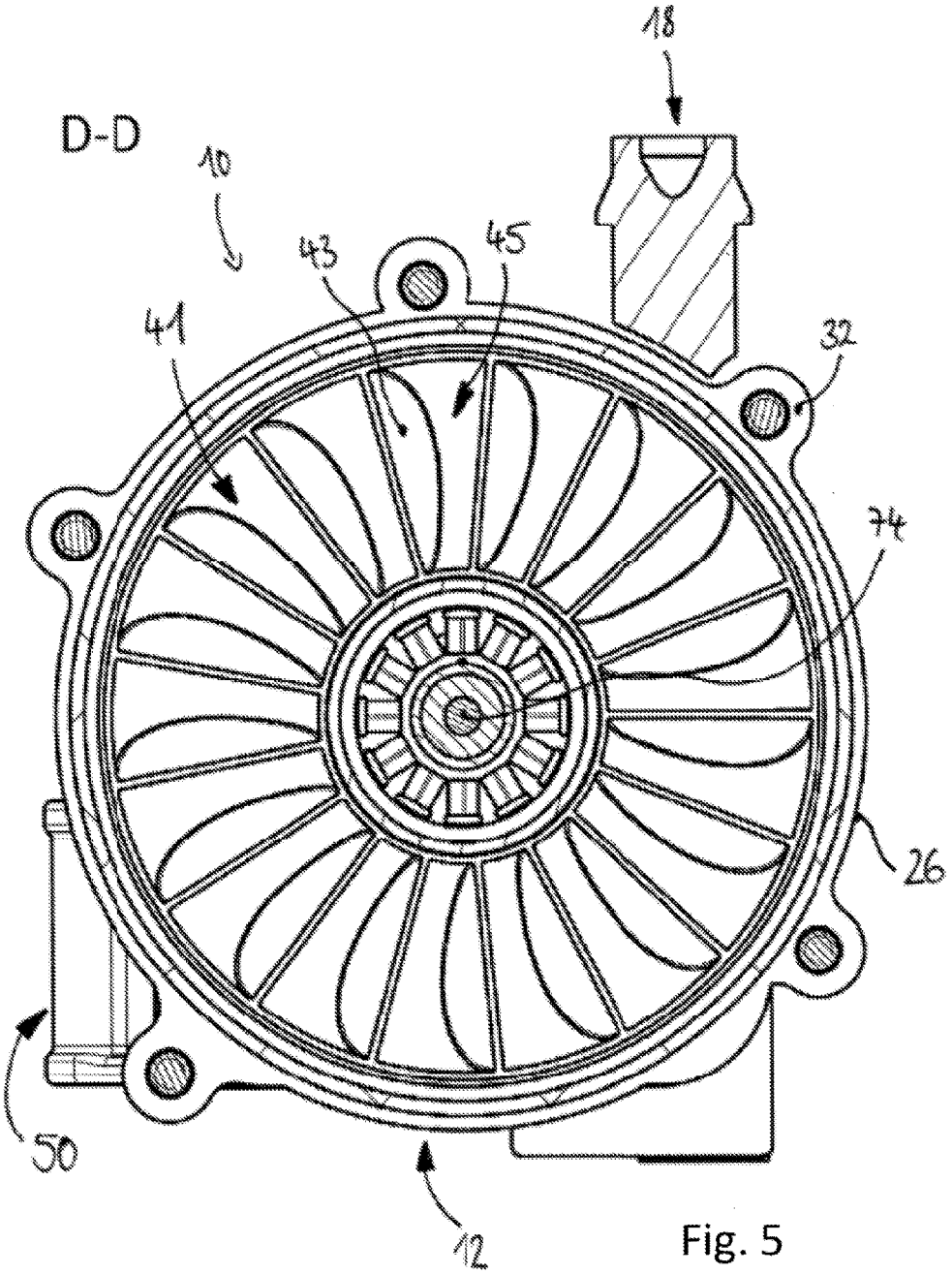
FIG. 5 is the suction device from FIG. 1 in a sectional view along the section axis D-D in FIG. 3.

The impeller 41 is shown in FIG. 5. The impeller 41 has a plurality of blades 43 which divide the impeller 41 into a plurality of chambers 45.

The third housing section 28 has a partition 44 and separates the interior of the second housing section 26 from the interior of the fourth housing section 30 (see FIG. 4).

The fourth housing section 30 delimits the housing 12 on the side facing away from the compressor 16. In addition, the fourth housing section 30 delimits a further receiving space 46, in which an electronic control 48 for the electric motor 14 is arranged, for example an assembled printed circuit board. In addition, two holders 50, 52 for fastening the suction device 10 are formed on the fourth housing section and project outwardly from the fourth housing section 30. In addition, outwardly projecting cooling fins 54 are formed on the fourth housing section 30 (see FIGS. 2 and 4).

The electronic control 48 for the electric motor 14 adjoins the fourth housing section 30 equipped with cooling fins 54 (see FIG. 4). The electronic control 48, for example an assembled printed circuit board, is in at least partial surface contact with the inside of the wall 55 of the fourth housing section 30.

The compressor 16 and the electric motor 14 overlap at least partially axially, the compressor 16 surrounding the electric motor 14 at least in sections radially outwardly (see FIG. 4). The electric motor 14 has an external rotor 56 and an internal stator 58 (external rotor motor). The rotor 56 is coupled to the impeller 41 of the compressor 16, in particular in a rotationally fixed manner.

The electric motor 14 has a preferably cylindrical cap 60 which is non-rotatably coupled to the rotor 56 and is connected to a motor shaft 62. The cap 60 has a wall 64 which is arranged radially between the rotor 56 and the compressor impeller 41, in particular contact sections 66 of the compressor impeller 41.

The motor shaft 62 is rotatably mounted on the second housing section 26 by means of bearings 68, 70, for example roller bearings. A sealing is produced on the motor shaft 62 via a seal 72, in particular a radial shaft sealing ring. The rotor 56 is connected in a rotationally fixed manner to the compressor impeller 41 via the wall 64. When the electric motor 14 is driven, the rotor 56 or the compressor impeller 41 rotates about the axis of rotation 74.

The electronic control 48 for the electric motor 14 adjoins the fourth housing section 30 equipped with cooling fins 54. The electronic control 48, for example an assembled printed circuit board, is in at least partial surface contact with the inside of the wall 55 of the fourth housing section 30.

The holder 42 and/or the holders 50, 52 are configured in such a way that heat can be dissipated from the interior of the housing 12. For this purpose, the holders 42, 50, 52 may be metallic and/or have comparatively large wall thicknesses.

As already explained, the housing 12 of the suction device 10 has a plurality of housing sections 24, 26, 28, 30 which adjoin one another at the parting planes 32, 34, 36. The parting planes 32, 34, 36 are in particular oriented orthogonally to the axis of rotation 74 of the electric motor 14 or of the compressor 16.

For improved heat dissipation, one or more, preferably all, housing sections 24, 26, 28, 30 of the suction device 10 are metallic.

As already explained above, the cooling effects achieved enable comparatively inexpensive components to be used for the electric motor 14 and/or electronic control 48. By arranging the electric motor 14 relative to the compressor 16, the electric motor 14 may be cooled by the crankcase gas passing through the compressor 16 (compressor channel 22). In addition, the cooling fins 54 can discharge heat from the interior of the housing 12 that is generated, for example, by the electric motor 14 and/or control 48, to the outside. Heat can be emitted from the interior of the housing 12 to surrounding components, for example to a housing or other components of the internal combustion engine, via the holders 42, 50, 52.

FIG. 6 shows a crankcase ventilation 100 and an internal combustion engine 200.

The crankcase ventilation 100 has a crankcase ventilation line 102, which is configured to connect (establishing a flow connection between the crankcase and the intake tract) the crankcase 202 of an internal combustion engine 200 to its intake tract 204 (e.g. air intake conduit). The connection opens in particular into a section of the intake tract 204 between the air mass meter 218 and the compressor 220 of a turbocharger.

The suction device 10 is connected to the crankcase ventilation line 102 via the connection points 18, 20 on the compressor 16, so that crankcase gas can be conveyed from the crankcase 202 to the intake tract 204 by means of the suction device 10. The crankcase pressure in the internal combustion engine 200 may be controlled by controlling the electric motor 14 that drives the compressor 16.

In the crankcase ventilation line 102, one or more oil mist separators 104, 106, for example a part-load separator 106 and a full-load separator 104, may be situated upstream of the suction device 10. Oil separated there may be returned via an oil return line (not shown) to the internal combustion engine 200, for example to its oil sump 206.

The internal combustion engine 200 has a crankcase ventilation 100 for discharging crankcase gas from the crankcase 202 as described above. The crankcase ventilation 100 has a suction device 10 for crankcase ventilation as described above.

The internal combustion engine 200 has further components. First of all, the internal combustion engine 200 has an intake tract 204 (air intake or supply line) and an exhaust tract 208 (exhaust gas line or discharge line). The intake tract 204 may extend from an air intake point 210 to the combustion chamber 212. The exhaust tract 208 may extend from the combustion chamber 212 to an exhaust gas discharge point 214 (e.g. exhaust muffler).

One or more of the following components are preferably provided in the intake tract 204: air filter 216, air mass meter 218 (e.g. hot film air mass meter), compressor unit 220 (e.g. compressor side of a turbocharger), charge air cooler 222, throttle valve 224.

A turbine unit 226 (turbine side of a turbocharger) may be provided in the exhaust tract 208. The turbine wheel of the turbine unit 226 may in particular be coupled in a rotationally fixed manner to the compressor wheel of the compressor unit 220 by means of a shaft 228.

The invention claimed is:

1. Suction device for crankcase ventilation of an internal combustion engine, comprising a housing having a wall, a controllable electric motor and a compressor driven by the electric motor for conveying crankcase gas, the compressor having an impeller and connection points for a crankcase ventilation line, such that the crankcase pressure of the internal combustion engine is controllable by controlling the electric motor, wherein the compressor and the electric motor at least partially overlap one another axially, the compressor surrounding the electric motor radially outwardly at least in sections, the electric motor has an externally running rotor which is coupled to the impeller of the compressor, and the compressor is configured as a side channel compressor.

2. Suction device according to claim 1, characterized in that the housing has one or more cooling fins projecting outwardly on a housing section facing away from the compressor.

3. Suction device according to claim 1, characterized in that an electronic control for the electric motor-is provided which adjoins the housing section equipped with cooling fins, with at least partial surface contact with the wall of the housing section.

4. Suction device according to claim 1, characterized in that the housing has a holder for attachment on a housing section facing away from the compressor and/or on a housing section bordering the compressor on the outside.

5. A crankcase ventilation for discharging crankcase gas of an internal combustion engine comprising a suction device comprising: a housing, a controllable electric motor, and a compressor driven by the electric motor for conveying crankcase gas, the compressor having an impeller and connection points for a crankcase ventilation line, such that the crankcase pressure of the internal combustion engine is controllable by controlling the electric motor, wherein the compressor and the electric motor at least partially overlap one another axially, the compressor surrounding the electric motor radially outwardly at least in sections, the electric motor has an externally running rotor which is coupled to the impeller of the compressor, and the compressor is configured as a side channel compressor.

6. An internal combustion engine comprising: a. a crankcase ventilation for discharging crankcase gas of an internal combustion engine comprising a suction device, wherein the suction device comprises: a housing, a controllable electric motor, and a compressor driven by the electric motor for conveying crankcase gas, the compressor having an impeller and connection points for a crankcase ventilation line, such that the crankcase pressure of the internal combustion engine is controllable by controlling the electric motor, wherein the compressor and the electric motor at least partially overlap one another axially, the compressor surrounding the electric motor radially outwardly at least in sections, the electric motor has an externally running rotor which is coupled to the impeller of the compressor, and the compressor is configured as a side channel compressor.

* * * * *